United States Patent [19]

Hudson

[11] 4,171,086

[45] Oct. 16, 1979

[54] SIGNAL DEVICE

[75] Inventor: Frederick W. Hudson, Henrietta, N.Y.

[73] Assignee: Vencraft Corporation, West Henrietta, N.Y.

[21] Appl. No.: 878,417

[22] Filed: Feb. 16, 1978

[51] Int. Cl.[2] ..... A47G 29/12

[52] U.S. Cl. ..... 232/35; 232/17

[58] Field of Search ..... 232/35, 34

[56] References Cited

U.S. PATENT DOCUMENTS

| | | | |
|---|---|---|---|
| 2,852,185 | 9/1958 | Stouten | 232/35 |
| 2,905,378 | 9/1959 | Cox et al. | 232/35 |
| 3,325,092 | 6/1967 | Hoffman et al. | 232/35 |
| 3,602,424 | 8/1971 | Raulston | 232/35 |
| 3,747,839 | 7/1973 | Morton | 232/35 |

*Primary Examiner*—Roy D. Frazier
*Assistant Examiner*—Peter A. Aschenbrenner

[57] ABSTRACT

A signal device for a mailbox comprising a pivotally mounted, weighted arm which is received by the mailbox door in the closed position. When the door is opened, the arm is released, whereby the weight urges the arm away from the box and into the signalling position.

10 Claims, 5 Drawing Figures

SIGNAL DEVICE

BACKGROUND OF THE INVENTION

This application relates to a device which signals the opening of a mailbox and is more particularly related to a device employed to signal the fact that a rural mailbox has been opened to receive mail.

In the past, many devices have been proposed for the purpose of signalling the owner of a rural mailbox the fact that mail has been inserted into the box by the U.S. Postal Service. Mainly, these devices have been actuated upon the opening of the mailbox door by means of spring devices or the signal means itself comprised a spring. A few examples of spring devices can be seen in U.S. Pat. No. 2,483,992 to Young, U.S. Pat. No. 2,730,298 to Haserodt, U.S. Pat. No. 2,924,376 to Johnson, U.S. Pat. No. 3,095,140 to Buedinger, U.S. Pat. No. 3,343,784 to Sowton and U.S. Pat. No. 3,343,784 to Woldhaus, et al. A signalling device comprising a spring can be seen in U.S. Pat. No. 3,102,684 to Eging and U.S. Pat. No. 3,338,511 to Cvar.

A moving weight balance signalling device is disclosed in U.S. Pat. No. 2,295,360 to Stapleton.

Such prior art devices inherently contain the problem of wear upon moving parts or the maintenance of spring tension over long periods of time. While the mannerism of attachment of these devices to the mailbox varies greatly, all require support from the mailbox.

It is, therefore, an object of this invention to provide a signalling device for door-accessed containers.

A further object of this invention is to provide a signal device which is relatively inexpensive to manufacture and simple to install.

A further object of this invention is to provide a mailbox signalling device having a minimum number of moving parts and thus a minimum of maintenance problems.

Other objects of this invention will become apparent upon reading the following specification and inspection of the attached drawings.

BRIEF DESCRIPTION OF THE INVENTION

The signalling device of this invention comprises a weighted signal arm pivotally mounted on a pivot arm. The device signals the opening of a container which is accessed through a door means. The door means receives the signal arm at its end opposite the weight affixed to it. The weight is situated so as to automatically raise the signal arm upon the release of the arm by opening of the door or any closure means for the container. The weight urges the rotation of the signal arm about the pivot arm bringing the signal arm away from the container thereby extending the signal arm well beyond the boundaries of the container walls so that the signal can be easily seen from a point remote from the container. Once the unweighted end of the signal arm is placed in the closure means, the signal is self-actuating upon opening the container by means of only one moving part.

BRIEF DESCRIPTION OF THE DRAWINGS

The invention will be more fully understood when described in conjunction with the attached drawings wherein.

DETAILED DESCRIPTION OF THE DRAWINGS

Figure 1:
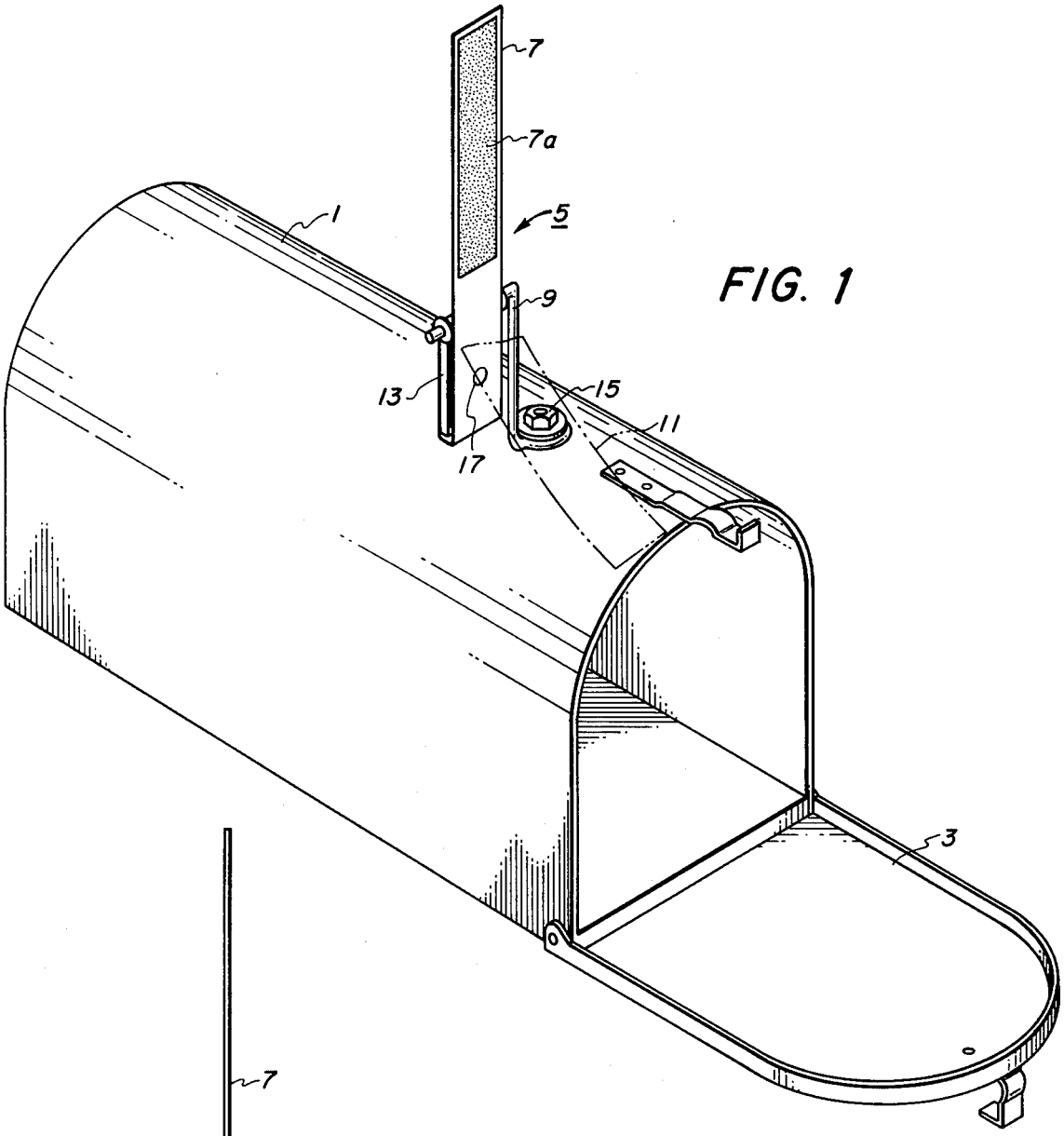
FIG. 1 is a perspective view of a mailbox having a signal device of this invention.

In FIG. 1 there is shown mailbox 1 with its door 3 open and signal device 5 in a signalling position. Signal device 5 comprises signal arm 7 on pivot arm 9 which is fastened to box 1. The signal device is attached to mailbox 1 by means of bolt arrangement 15 through the box and a loop in pivot arm 9. The non-signal position of signal arm is shown by dotted lines 11.

In such non-signalling position as shown in FIG. 1, the end of signal arm 7 is positioned in the clearance normally provided between door 3 and box 1. If such clearance is not provided, the door can be easily modified by raising the flange over an area adequate to receive signal arm 7 in the closed position. Upon opening the door to insert mail, the signal arm is driven upward into the signalling position by weight 13 attached or integrally a part of signal arm 7. The force provided by the weight 13 is sufficiently in excess of the opposing force of signal arm 7 to automatically raise the signal arm into the signalling position when the door is opened.

There is shown in FIG. 1 a simple, yet automatically operated signal device. Optionally, signal arm 7 may be provided with attractive colors or colored reflective material adhered thereto for the purpose of making the signal more easily visible from a distance. This optional embodiment is indicated in FIG. 1 as portion *7a* of signal arm 7 which may take the form of reflective pressure sensitive tape applied to the signal arm.

Figure 2:
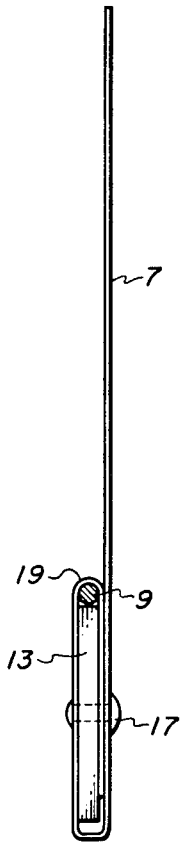
FIG. 2 is a side elevation of the signal device of this invention.

FIG. 2 is a side elevation of signal arm 7 showing the position of weight 13 enclosed by a continuation of signal arm 7. Further, FIG. 2 shows the hinge arrangement of signal arm 7 around pivot arm 9 whereby a single, continuous strip of material can be utilized to form the signal arm, encase the weight 13 and form hinge 19. Weight 13 is securely fastened to signal arm 7 by rivet 17. Weight 13 can be affixed to arm 7 by any convenient manner and may comprise a mere continuation of arm 7 in tightly coiled form so as to provide a counterbalance weight.

Figure 3:
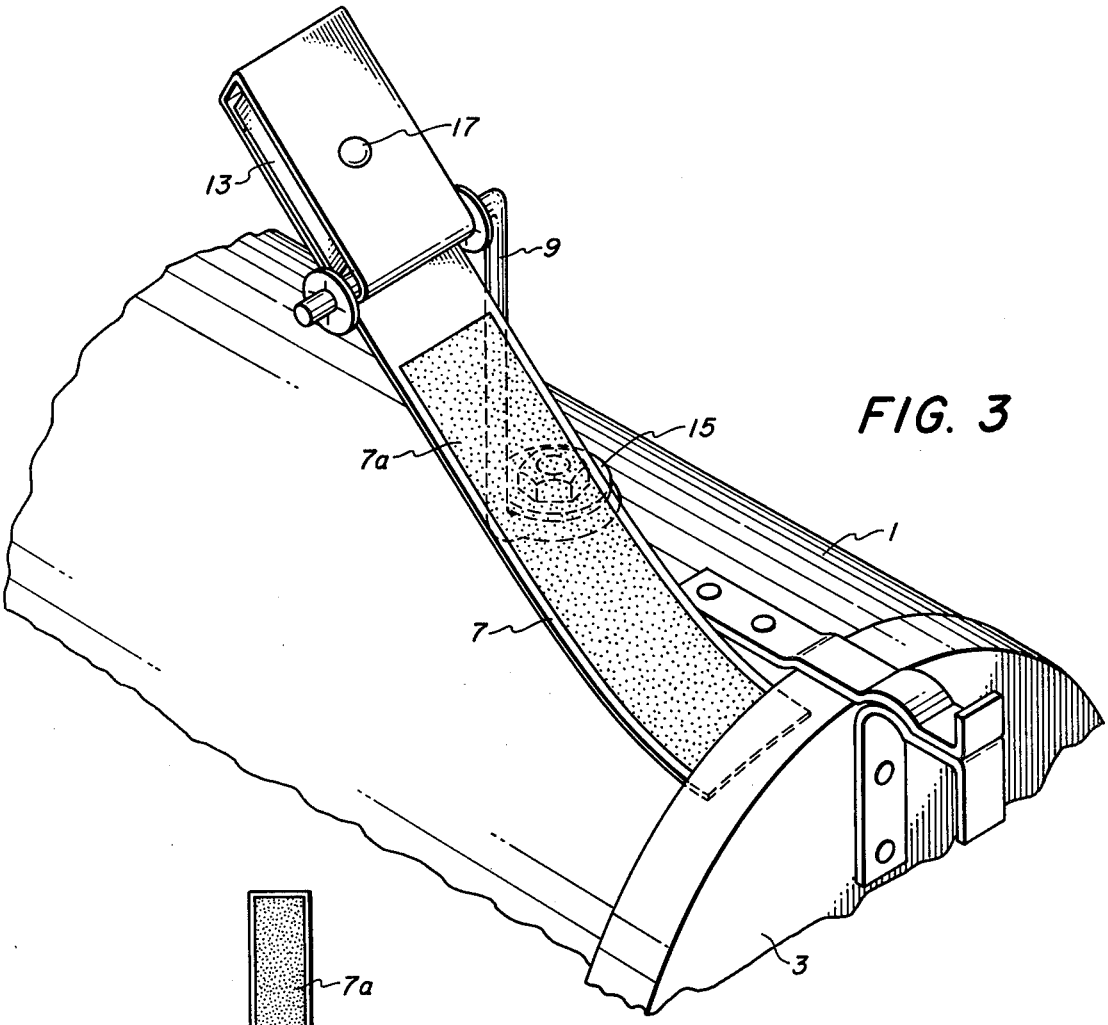
FIG. 3 is a perspective view of a mailbox having a signal device of this invention wherein the signal arm is in the stored position.

In FIG. 3, the signal device of this invention is shown in greater detail in its stored position. Door 3 is shown in the closed position whereby it overrides the end portion of signal arm 7. The covered portion of signal arm 7 is shown in dotted line form. In this embodiment, weight 13 is shown as a separate block fastened to signal arm 7 by rivet 17. This simplified embodiment offers obvious economy in manufacture by utilizing a flat strip material such as sheet metal and forming a frame for weight 13. The other component parts of the invention illustrated in FIG. 3 are designated numerically as in FIG. 1.

Figure 4:
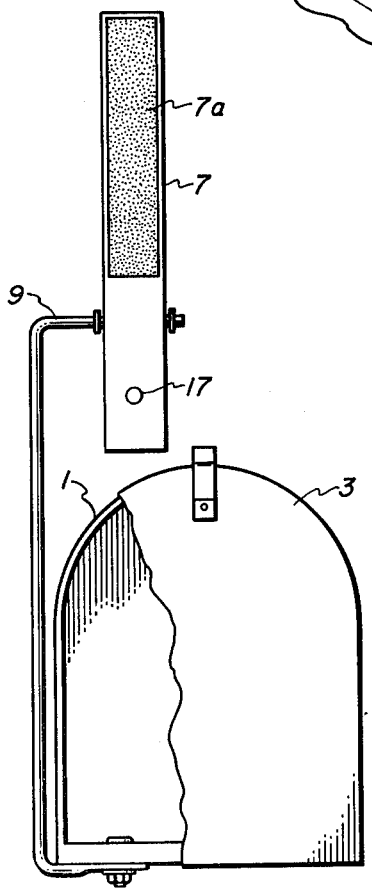
FIG. 4 is a front elevation of another embodiment of the signalling device of this invention wherein the signal arm is in the signalling position.

FIG. 4 illustrates another embodiment of this invention wherein pivot arm 9 is fastened to the bottom of box 1. Alternatively, pivot arm 9 can be fastened to the same support as box 1 rather than directly to box 1.

Thus, a signalling device can be utilized which does not modify the mailbox. Obvious advantages are obtained by utilizing this device without altering the mailbox. Numerical designations of FIG. 4 are the same as in FIG. 1.

Figure 5:
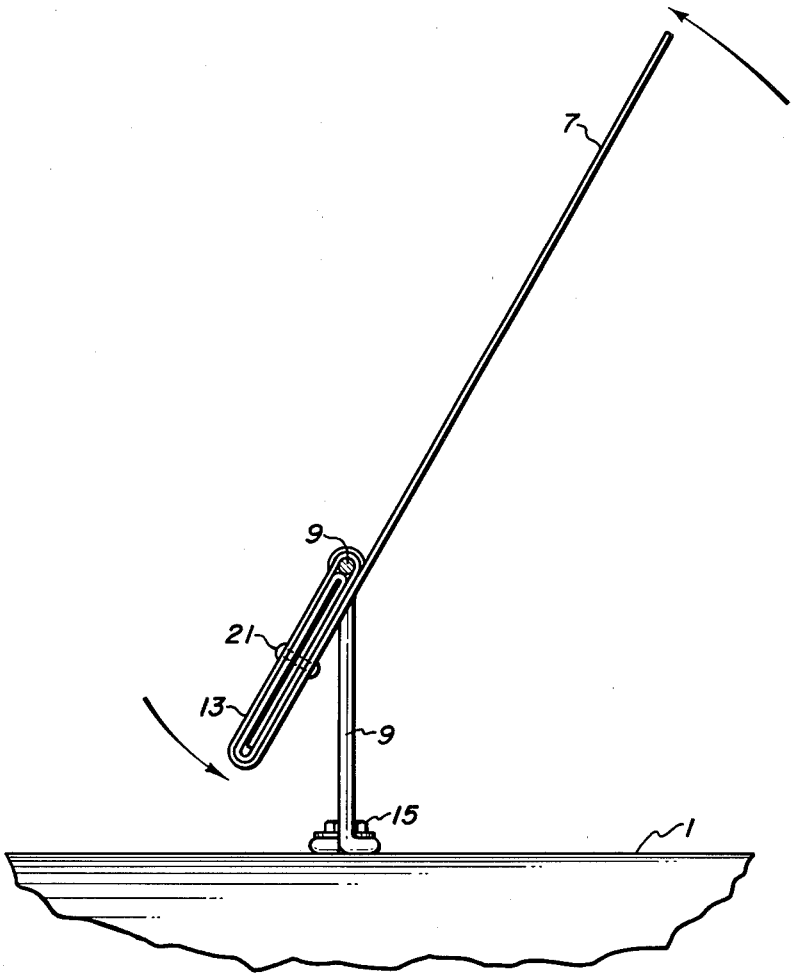
FIG. 5 is a side elevation, in partial section, of another embodiment of the signal device of this invention.

FIG. 5 illustrates the embodiment of this invention wherein signal arm 7 forms weight means 13 by being tightly coiled. Pin 21 holds the coil in place.

There has thus been described an improved signalling device which is economical to manufacture, simple in operation and readily adapted for use on existing mailboxes. Various changes in the details, materials and arrangement of parts can be made other than those described and illustrated above which will occur to and may be made by those skilled in the art upon reading of this disclosure and such changes are intended to be included within the scope of this invention.

What is claimed is:

1. A signal device for a container, said container having a door means in one side thereof, said door means having a clearance between said door and container, comprising a pivot arm, a pivotally mounted signal arm on said pivot arm, said arm having a weight means on one end thereof, said pivot arm extending above said container a sufficient distance at the point of said mount to allow said weight means to pass between said pivot arm and said container upon rotation of said signal arm, allowing said signal arm to extend upward from said container in the signal position, the end of said signal arm opposite said weight means capable of being positioned in said clearance in the stored position, said signal arm being visible in both the stored and signal positions from any remote point from which the container is in view.

2. The signal device of claim 1 wherein said weight means comprises a continuation of said signal arm tightly coiled.

3. The device of claim 1 wherein the container is a mailbox.

4. The device of claim 3 wherein the pivot means is mounted on said box.

5. The device of claim 1 wherein the pivot means is mounted on a support means adjacent to the container.

6. The device of claim 3 wherein the arm contains a visually attractive colored material.

7. The device of claim 1 wherein the weight means is integral with said arm.

8. The device of claim 3 wherein the pivot arm is attached to the bottom of said mailbox.

9. The device of claim 1 wherein said signal arm encases said weight and wherein said arm is a flat strip of material forming a frame for said weight.

10. The device of claim 1 wherein said signal arm forms a hinge means on said pivot arm.

* * * * *